United States Patent [19]

Marzoli

[11] 3,946,956

[45] Mar. 30, 1976

[54] CONTROL DEVICE FOR EQUIPMENT FOR WINDING YARN INTO COPS

[75] Inventor: Angelo Marzoli, Bergamo, Italy

[73] Assignee: F.lli Marzoli & C. S.p.A., Palazzolo Sull'Oglio (Brescia), Italy

[22] Filed: Dec. 27, 1973

[21] Appl. No.: 428,770

[30] Foreign Application Priority Data

Dec. 29, 1972 Italy ..... 33792/72
Aug. 10, 1973 Italy ..... 27785/73

[52] U.S. Cl. ..... 242/26.1; 242/26.3; 242/26.4; 242/43.1

[51] Int. Cl.[2] ..... B65H 54/32; B65H 54/36

[58] Field of Search ..... 242/26.1–26.4, 242/43, 43.1, 158 R, 158 F, 158.4 R

[56] References Cited

UNITED STATES PATENTS

| | | | |
|---|---|---|---|
| 2,539,267 | 1/1951 | Nikles | 242/43 |
| 2,647,698 | 8/1953 | Woolley | 242/26.1 |
| 2,749,055 | 6/1956 | Bauer | 242/26.2 |
| 3,130,930 | 4/1964 | Miller | 242/26.3 |
| 3,245,215 | 4/1966 | Graf | 242/26.1 X |
| 3,286,941 | 11/1966 | Schippers et al. | 242/26.1 |
| 3,302,381 | 2/1967 | Pfeifer | 242/26.3 X |
| 3,334,828 | 8/1967 | Harrison | 242/26.1 |
| 3,367,588 | 2/1968 | Wolf | 242/26.3 |
| 3,484,050 | 12/1969 | Davies | 242/26.3 |
| 3,695,529 | 10/1972 | Hori et al. | 242/26.3 |

FOREIGN PATENTS OR APPLICATIONS

| | | | |
|---|---|---|---|
| 626,177 | 7/1949 | United Kingdom | 242/26.1 |

*Primary Examiner*—Stanley N. Gilreath
*Attorney, Agent, or Firm*—Haseltine, Lake & Waters

[57] ABSTRACT

A control device for the winding of yarn onto a cop and particularly for an actuator controlling the relative motions between the cop being wound and winding means, said actuator periodically reversing its motion, wherein said actuator is linked either to support means bearing two linearly extended and adjustable stop means or to a control member therefor, whereby said actuator is controlled to reverse its motion by the alternated engagement of the control member with said stop means, whereby the point of engagement of the stop means with the control member is adjustably controlled; and in particular which enables variously wound cops to be formed without requiring the replacement of parts.

6 Claims, 10 Drawing Figures

CONTROL DEVICE FOR EQUIPMENT FOR WINDING YARN INTO COPS

In textile spinning and twisting machines cops of various shapes are notably formed by providing controlled mutual movement between the rotating spool which receives the yarn and the members which wind and guide the yarn.

The control device for this movement must be adjustable in order to determine the various shapes of the cops as required in turn.

The aforementioned mutual movement is notably generally reciprocating, and its amplitude termines the height of the winding, while the instantaneous speed determines the profile of the cop.

It has been proposed to control the movement between the rotating spool and the winding and thread guide members by cams on which act followers which in various manners regulate by their movement the movement of the members which wind and guide the yarn. The profile of the cams is consequently univocally related to the profile of the cops.

In order to vary the shape to be given to the cops, this solution requires the replacement of the cams by others of suitable profile. The replacement of the cams is generally an operation which is rather delicate, laborious, and requires the availability of a considerable variety of interchangeable cams, each type suitable for obtaining one of the many forms of cops requested by the market.

The object of this invention is to provide a control device for the mutual movement between the cop being wound and the rail carrying the rings and the thread guides, which does not give rise to the disadvantages of known types, and in particular which enables variously wound cops to be formed without requiring the replacement of parts.

A further object of the invention is to provide a device of this type which permits rapid and accurate adjustment of the manner of laying the yarn on the rotating spool without requiring laborious operations, which give rise to unacceptable down times for the entire winding equipment.

These and further objects which will be more evident hereinafter, are attained according to the invention by providing a control device for an actuator provided with movement in strokes of alternate direction for controlling the mutual movement between a cop being wound and winding and guide means for the wound yarn, comprising a member for controlling the reversal of motion of the actuator by the action of its engagement against a striker, and a support for two opposing strikers arranged to act on the control member, of said member and support, at least one being kinematically linked with said actuator in order to effect a mutual stroke which is a function of the stroke of the actuator, during which said member moves between the strikers in a first direction, there being also provided drive means for mutually moving said control member with respect to said support in a second direction orthogonal to the first in order to vary the zone of said strikers in which said member strikes.

It has been found possible in this manner, by varying the speed of sliding of the control member on its carriage and the position of the engagements on the plate, to obtain cops wound in any of the shapes required by the market.

For major clarity one embodiment of the invention will be illustrated hereinafter by way of example, illustrated in the accompanying drawings in which:

FIGS. 1 to 3 show diagrammatic views of the control device for the mutual movement between the rings, the thread guides and the cops, in a drawing and twisting machine.

Figure 1:
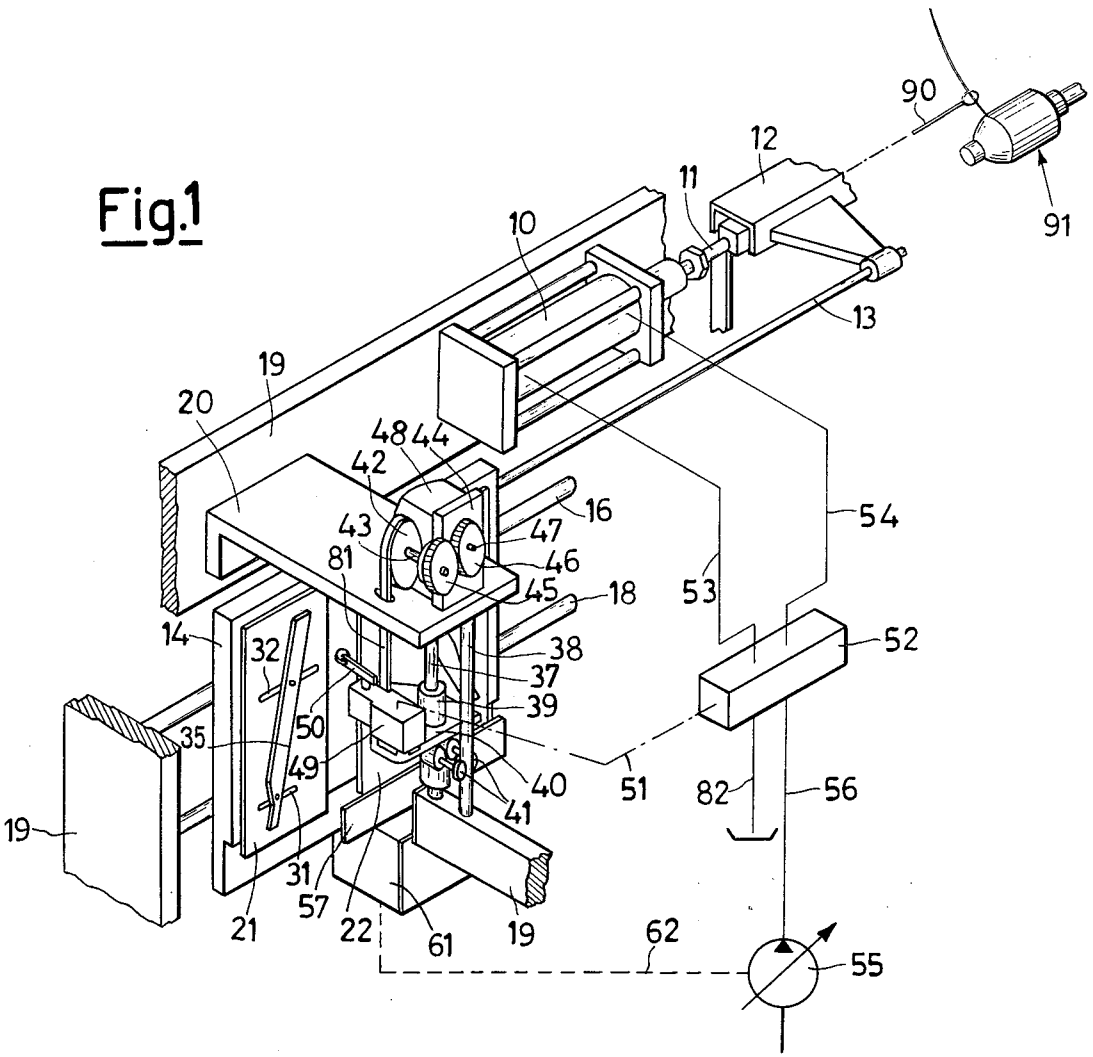
FIG. 1 is a diagrammatic perspective view of a device according to the invention.

The control element for the mutual motion consists of a hydraulic cylinder 10, the rod 11 of which is connected to a tie bar 12, kinematically linked in known manner to the carriage which carries the rings and the thread guides.

Mutually mobile arrangements between the rings, the thread guides and the cops are well known. The figures indicate one system showing a cop 91 and the thread guide 90 moved by the tie bar 12. Obviously the tie bar 12 could move a carriage carrying the cops 91 being wound, or move both the thread guides and the cops with the desired mutual motion.

The tie bar 12 is connected by the rod 13 to a slider 14 supported slidably by the sleeve 15 on the guide 16, and guided by rollers 17 on the guide 18. The guides 16 and 18, and the cylinder 10, are carried by a frame 19 from which a bracket 20 projects.

The slider 14 carries rigidly panels 21 and 22, of which the panel 22 is fixed in an adjustable manner by screws 23 housed in slots 24 formed in the panel. The panel 22 also comprises two longitudinal parallel slots 25 and 26, constituting seats for screws 27 and 28 which fix a rod 29 comprising a through groove 30 in which said screws are housed. In the same manner longitudinal slots 31 and 32 in the panel 21 form seats for screws 33 and 34 for fixing a rod 35, which comprises a through groove 36 in which the screws 33, 34 are housed.

The bracket 20 extends above the slider 14 and is connected by two parallel uprights 37 and 38 to the lower part of the frame 19. The uprights 37 and 38 face the panels 21 and 22. The upright 37 slidably supports a sleeve 39 of a platform 40 guided by the column 38 by means of rollers 41.

The platform 40 is connected to one end of a belt 81 which passes through the bracket 20, its other end being fixed to a pulley 42 mounted rigidly on a spindle 43 supported by a plate 44 fixed to the bracket 20. The spindle 43 passes rotatably through the plate 44 and rigidly carries a gearwheel 45 engaging with a second gearwheel 46 keyed on to the spindle 47 which rotatably passes through the plate 44. The spindle 47 is connected to a geared motor, preferably hydraulic, indicated by 48.

The platform 40 rigidly carries a microswitch 49 comprising a rotatable control lever and electrically connected by way of the line 51 to an electrically controlled valve 52 comprising a four way valve which controls the flow in the lines 53 and 54 which feed the cylinder 10. Oil under pressure arrives at the valve 52 from a variable flow pump 55 through a line 56. A line 82 leads to drain.

The lower side of the slider 14 carries a blade 57 the inclination of which can be varied in known manner by knobs 58. The inclination of the blade 57 is shown on scales 59. The blade is in contact with a wheel 60 of a device 61 fixed to the frame 19 and arranged to vary the flow of oil in the line 56 in accordance with the inclination of the blade 57, by acting in known manner on the variable flow pump 55 by way of the line 62.

Figure 3:
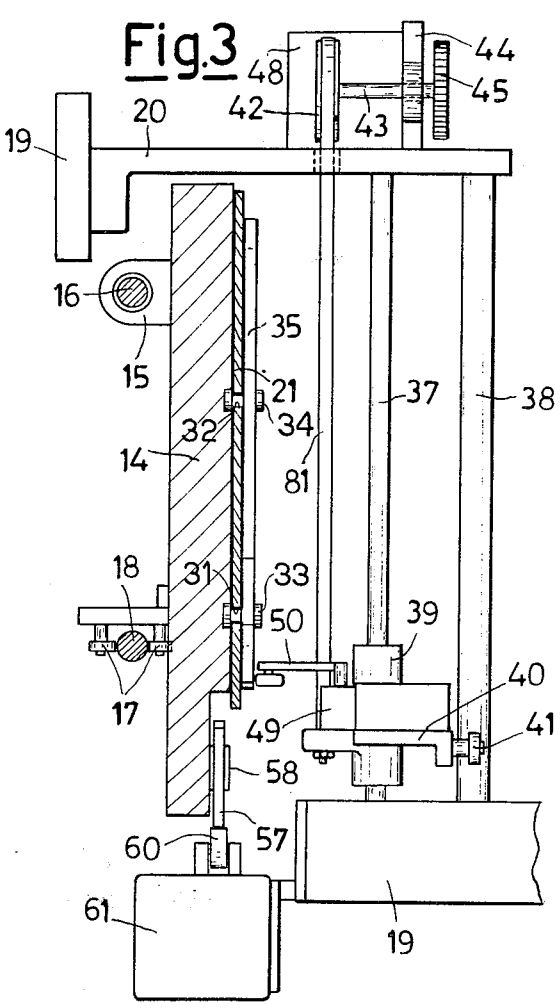
FIG. 3 is a sectional view of the plane III-III of FIG. 2.
Figure 2:
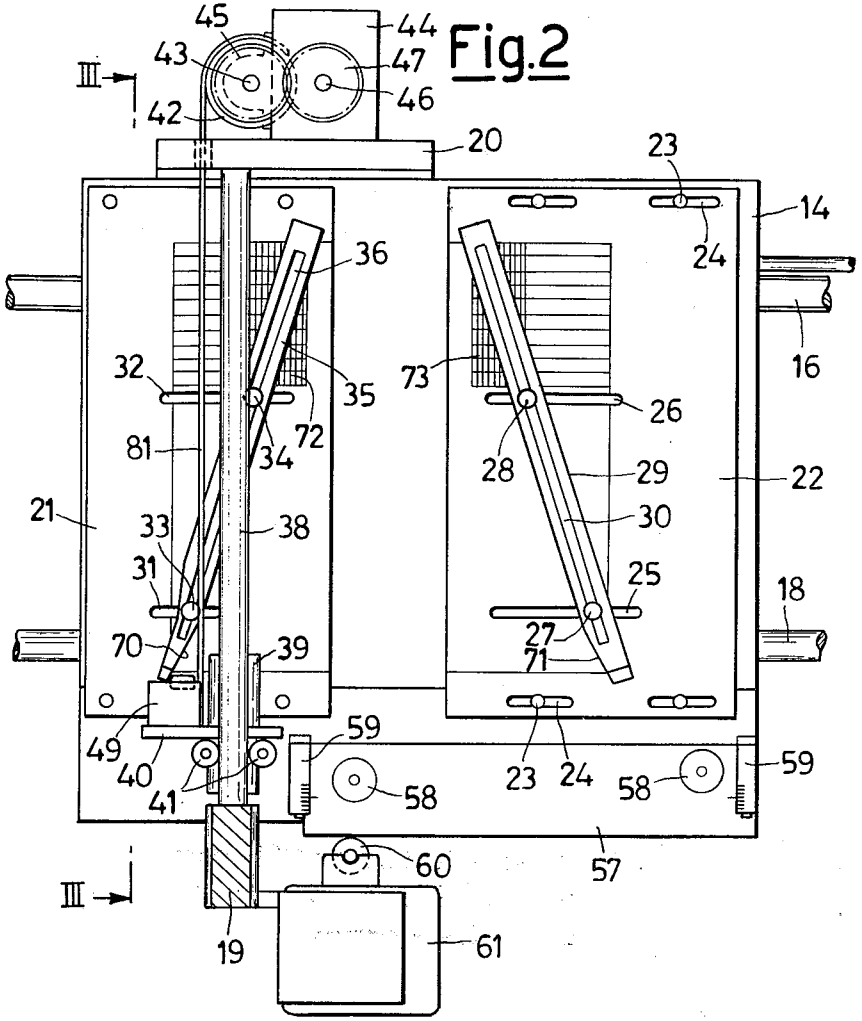
FIG. 2 is a frontal view of the slideable frame of the device of FIG. 1.

As shown in FIG. 3, the rods 29 and 35 have tapered portions 70 and 71 for varying the mutual inclination between the two rods.

The panels 21 and 22 are provided with scales 72 and 73 designed to make the mutual positioning of the rods 29 and 35 rapid.

The operation of the device according to the invention is as follows.

When the piston of the cylinder 10 is in the withdrawn position, the lever 50 of the microswitch 49 is in contact with the rod 29. In this moment the valve 52 is controlled in such a manner that it connects the line 56 to the line 53 and the line 82 to the line 54. The pump 55 hence feeds oil under pressure into the cylinder 10. The piston of the cylinder moves the rod 11 and hence the tie bar 12. The piston of the cylinder 10 moves towards the right in FIG. 1 until the lever 50 touches the rod 35. At this point the microswitch is operated and transmits a signal through the line 51 to the valve unit 52 which moves the directional valve so that the line 54 is connected to the line 56 and the line 53 to drain 82. In consequence the oil under pressure is fed into the cylinder 10 through the line 54, until the lever 50 comes into contact with the rod 29, and the cycle begins again.

In this manner reciprocating motion of the tie bar 12 is attained, the stroke of which is proportional to the mutual stroke between the ring carriage and cop carriage.

The drive unit 48 is operated at the beginning of the winding of the cops and moves the platform 40 vertically so that the zone of the rods 29 and 35 against which the sensor 50 engages varies continuously. By varying the angle between the rods and the speed of movement of the motor 48, the height of the winding and the shape of the cop can be adjusted moment by moment.

For example by stopping the motor 48, i.e., arranging the rods 29 and 35 parallel and vertical, a winding is obtained of constant height, giving a cylindrical cop.

Figure 4:
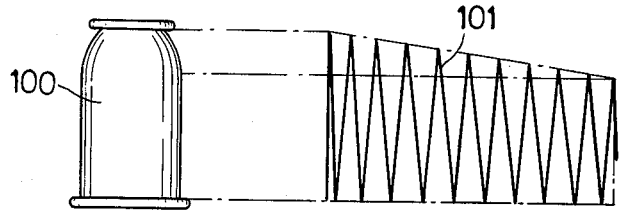
FIG. 4 is a winding pattern for one type of cop.
Figure 6:
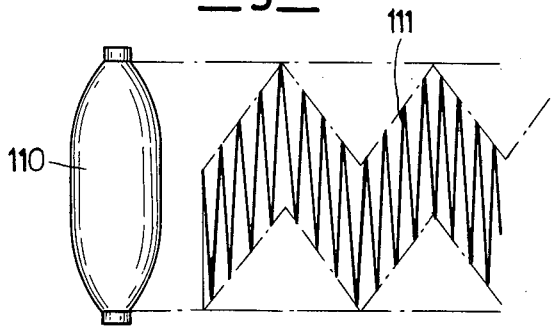
FIG. 6 is a winding pattern for a further type of cop.

Slightly more complicated cop shapes are shown in FIGS. 4 and 6.

Figure 5:
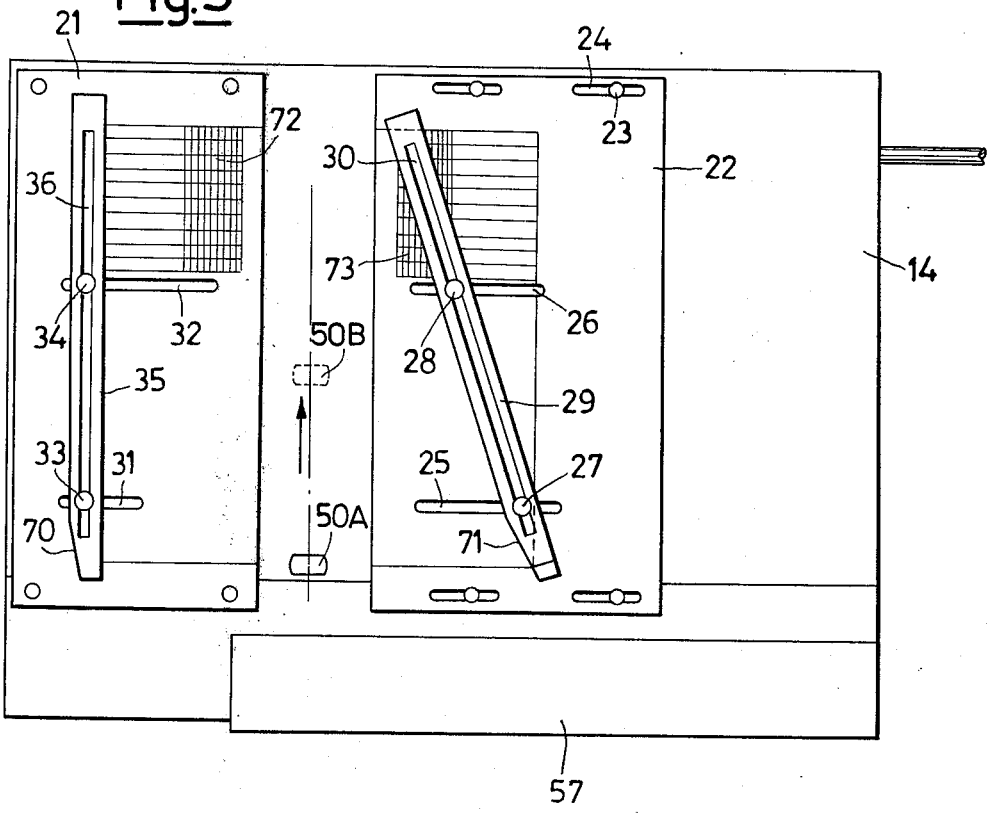
FIG. 5 is a detailed view of the device for winding the cop of FIG. 4.

FIG. 4 shows a cop 100 of conocylindrical type. FIG. 5 shows how the rods 29 and 35 must be disposed in order to provide a cop winding as shown in FIG. 4.

The initial position on the vertical of the sensor 50, indicated by 50*a*, corresponds to the maximum distance between the rods 29 and 35, and hence to the maximum winding stroke. During winding the motor 48 moves the platform 40 with a single stroke upwards, so that at the end of the winding the sensor 50 is in the position 50B where the winding stroke is minimum.

The pattern of these strokes is shown by the dotted line 101 in FIG. 4.

Figure 7:
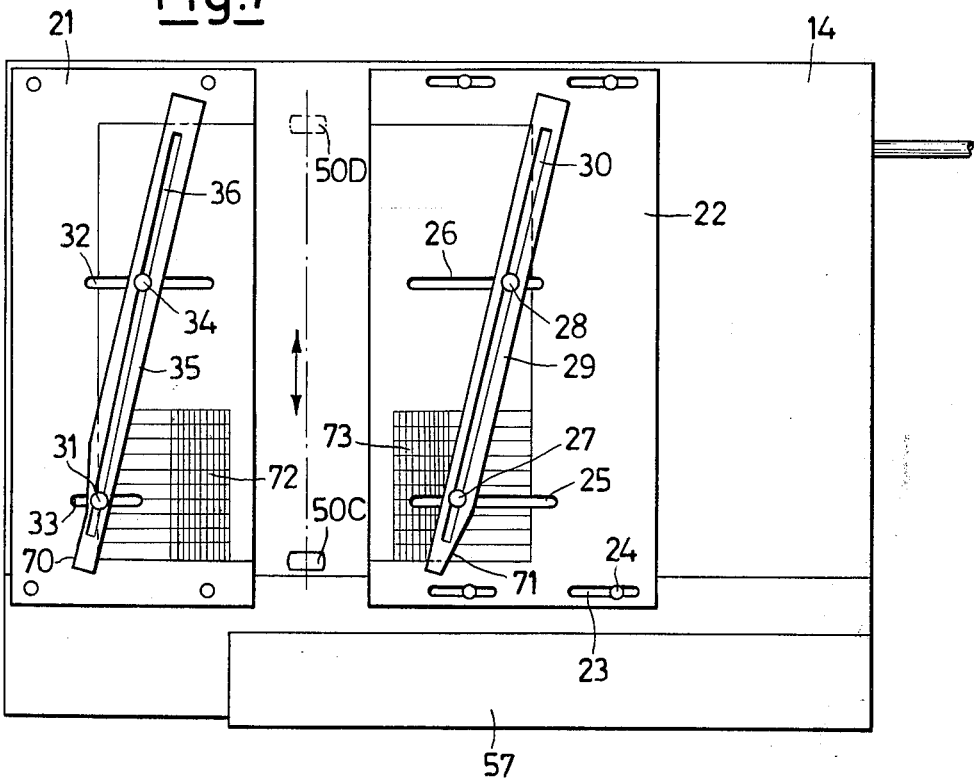
FIG. 7 is a detailed view of the device for winding the cop of FIG. 6.

FIG. 6 shows the double taper continuous cop 110, wound with winding strokes indicated by the adjacent dotted line 111. In order to carry out this winding the rods are disposed as shown in FIG. 7. The winding stroke moment by moment is constant, but it moves along the winding spool. The motor 48 drives the platform 40 with reciprocating motion, so that the sensor 50 moves with reciprocating motion between the positions 50C and 50D.

The tapered portions 70 and 71 enable the well known conical tapered cops or cones of perfectly straight inclination to be obtained, in that said portions avoid an initial winding of convex shape.

It is evident that by varying the mutual distance and inclination of the rods to the vertical, the taper can be changed as required.

It will be easy for the expert of the art to determine in turn the position of the rods and speed of the motor 48 for obtaining the desired shape of the cop to be wound.

More complicated cop shapes can be obtained through manipulation of blade or cam 57 so as to vary its inclination as described above. By thus changing the disposition of cam 57, the device 61 is caused to vary the flow rate of the pump 55 and thereby vary the instantaneous speed of the actuator (cylinder 10).

The vertical stroke of the platform 40 may be easily limited by limit switches which control the reversal or movement of the geared motor 48, in known manner.

Figures 8, 9, 10:
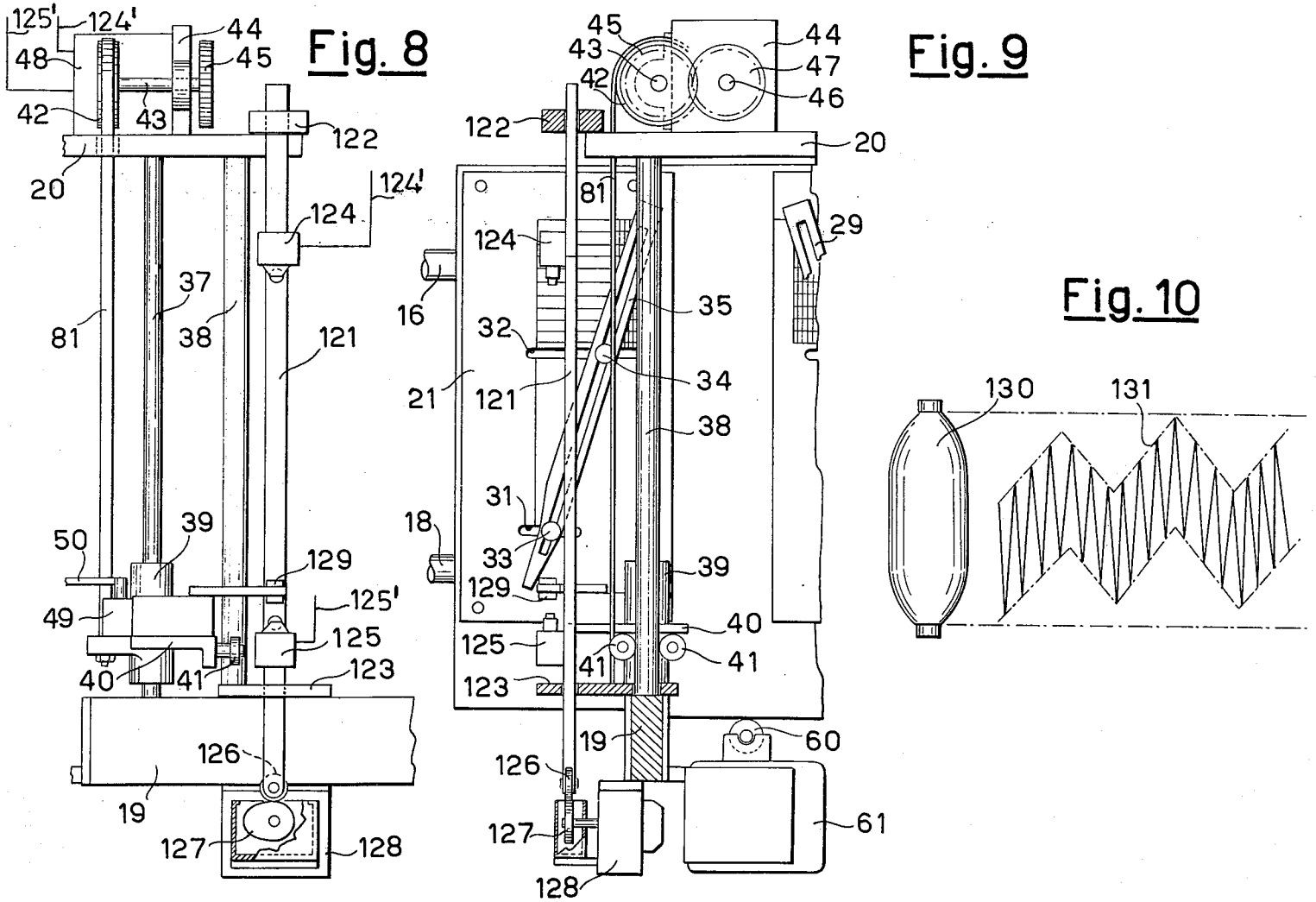
FIGS. 8 and 9 are lateral and frontal views of a further embodiment of the device according to the invention.
FIG. 10 is a winding pattern which can be attained with the device of FIGS. 8 and 9.

FIGS. 8 and 9 show one embodiment of the invention which is particularly suitable for resolving the difficulty of disposing the yarn in properly aligned turns without mutual overlap. When fibres of low coefficient of friction are worked, such as certain fibres of continuous filament (artificial and/or synthetic) the turns of the cop slide relatively, especially at the tapers at the ends of the cop, so causing the so-called fall of the yarn. This causes a disordered configuration of the cop, and prejudices the subsequent workability of the yarn. As shown in FIGS. 8 and 9, a guide 122 is fixed on the bracket, and a guide 123 rigidly fixed to the frame 19 is vertically aligned and spaced from it. In the guides 122 and 123 is slidably mounted a rod 121 carrying at that end of it which projects below the guide 123 an idle wheel 126. An eccentric 127 rotatably supported in the frame 19 and driven by a motor 128 acts lowerly on the wheel 126. The rod 121 carries, rigid with it, a microswitch 124 disposed close to the underside of the bracket 20 and a microswitch 125 disposed adjacent guide 123 on the side thereof opposite wheel 126. The two microswitches 124 and 125 are electrically connected by lines 124' and 125' to the motor 48 which drives the platform 40 so that when one of said microswitches is operated, the direction of motion of the motor 48 is reversed. The two microswitches 124, 125 are furthermore so disposed as to come into contact, when said platform is moved along the upright 38, with a sensor 129 formed from a square element and fixed to the platform 40.

The operation of the device according to the invention is as follows:

It will be supposed that the rods 29 and 35 are disposed parallel to each other on the panels 21 and 22 of the carriage 14. The winding stroke is constant at each moment but moves along the winding spool. The configuration of the cop will comprise a double taper and is particularly exposed to the fall of the winding turns.

When the drive element of the carriage 14 and the motor 48 are operated, the carriage 14 is moved in a reciprocating manner horizontally between the positions defined by the sensor 50, which in its turn moves vertically as its platform 40 is driven by the motor 48.

The stroke of the platform 40 and hence of the sensor 50 is delimited by the microswitches 124 and 125, each of which by coming into contact with the sensor 129 reverses the direction of motion of the motor 48. Said position of reversal is not fixed however but varies according to the height of the eccentric 127 which moves the rod 121 in a reciprocating manner and hence the microswitches 124 and 125.

FIG. 10 shows a cop 130 with the relative pattern as shown by the dotted line 131 resulting from the aforementioned operational procedure. It can be seen that although the winding stroke of the yarn is constant, it moves along the winding spool without any dependence on the speed of the platform. The motor 128 drives the eccentric independently of the speed of the motor 48. Thus for example the motor 128 could rotate the eccentric at a speed of one revolution every 5 minutes, while the motor 48 could move the platform at a speed of one complete stroke every 3 minutes.

The microswitches 124, 125 are preferably fixed in an adjustable manner along the rod 121. In certain cases a sensor 129 of larger dimensions could be used.

The depositing of the yarn at the ends of the cop being wound thus takes place without any build-up, because the yarn is not wound always at the same points of the end portions of the cop.

Evidently where the type of yarn does not have a tendency to fall or for the turns to overlap, the sensors 124 and 125 may be kept in the fixed position.

What is claimed is:

1. A control device for controlling the relative movement between a cop and yarn handling and guiding elements in textile spinning and twisting machines so as to wind the yarn upon cops having various shapes comprising a frame, a reciprocable actuator member carried by said frame, a support member slidably carried by said frame, a pair of spaced striker elements adjustably mounted on said support member, control means for regulating the reciprocation of said actuator member along a first predetermined path, said control means including a control member positioned between said striker elements, at least one of said control member and support member being operatively connected to said actuator so as to provide for alternating engagement of said striker elements by said control member for regulating the reciprocation of said actuator member along said first predetermined path, drive means for reciprocating said control member relative to said support member along a second predetermined path which is perpendicular to said first path and generally parallel to the plane in which said striker elements are disposed whereby said control member is engageable with different lineal portions of said striker elements, second control means being provided for reversing the relative motion of said control member and support member along said second predetermined path including limit sensor means and a contacting element carried by said control member engageable therewith at predetermined positions along the second path of movement of said control member.

2. A control device as claimed in claim 1, in which said actuator comprises a double acting hydraulic cylinder having a pair of opposed chambers, said control member comprising a valve unit which alternately connects the chambers of said cylinder to a source of liquid under pressure.

3. A control device as claimed in claim 1 in which said striker elements comprise rods carried by slots in said support member, said rods having tapered end portions for varying the mutual inclination of the said rods.

4. A control device as claimed in claim 1, in which said support member is provided with scales for accurate and simple positioning of the striker elements.

5. A control device as claimed in claim 1, in which said limit sensors are supported by an element movable with reciprocating movement in a parallel direction, with smaller amplitude and with a different period, to said second path.

6. A control device as claimed in claim 5, in which the element carrying said limit sensors is in the form of a rod which is maintained in yieldable engagement with a rotatable cam member.

* * * * *